United States Patent [19]

Broussard

[11] 4,450,606

[45] May 29, 1984

[54] SLIP ELEVATOR

[76] Inventor: Baron T. Broussard, 1030 Granger St., Jennings, La. 70546

[21] Appl. No.: 368,757

[22] Filed: Apr. 15, 1982

[51] Int. Cl.[3] ..... E44B 21/00; E21B 3/04

[52] U.S. Cl. ..... 188/67; 175/422; 294/102 A

[58] Field of Search ..... 24/249 DP, 263 SW, 263 SB, 24/263 B, 263 D, 263 DA, 263 CA, 263 DC, 263 DT; 294/86.19, 102 A, 99 S; 187/84, 88; 166/75 R

[56] References Cited

U.S. PATENT DOCUMENTS

| | | | |
|---|---|---|---|
| 136,812 | 3/1873 | Bullock | 294/102 A |
| 1,375,964 | 4/1921 | Hiniker | 294/102 A |
| 1,499,635 | 7/1924 | Benckenstein | 24/249 DP |
| 1,664,461 | 4/1928 | Montgomery | 294/102 A |
| 1,676,275 | 7/1928 | Montgomery | 294/102 A |
| 1,966,454 | 7/1934 | Moody | 294/102 A |
| 2,245,592 | 6/1941 | Jones | 24/263 LA |
| 3,122,811 | 3/1964 | Gilreath | 24/263 DA |
| 4,253,219 | 3/1981 | Krasnov | 24/263 D |

*Primary Examiner*—Gene Mancene
*Assistant Examiner*—John G. Weiss

[57] ABSTRACT

A slip elevator apparatus for elevating hand-type slips and slip assemblies provides a frame and has means accompanying the frame for removably affixing the frame to a drilling rig rotary table allowing the frame to rotate therewith, with the frame occupying during operation a peripheral position on a rotary table, leaving an open center. Linkage forms a connection between the frame and a set of hand slips to be lifted. The linkage is movably disposed with respect to the frame between upper and lower positions. Biasing preferably in the form of a plurality of coil springs is provided for biasing the linkage to the upper position thus elevating connected slips. In order to overcome the biasing, footpegs are provided for applying the weight of a human operator, roughneck, or the like so as to overcome the bias and move the linkage and connected slips into the lowermost position where they are used to grip the drill pipe.

9 Claims, 11 Drawing Figures

SLIP ELEVATOR

BACKGROUND OF THE INVENTION

1. Field of the Invention

The present invention relates to oilfield drilling equipment and, more particularly relates to devices useful in the insertion and removal of slips (which support the drill pipe) in and from the area of a rotary table having pin openings normally receptive of the master bushing. Even more particularly, the present invention relates to a power assisted slip elevator which connects to and rotates with the rotary table "pin openings" operating "hand slips" normally lifted by human laborers, roughnecks or the like.

2. General Background

In the oilfield, when drilling for oil or gas there is used a platform which supports a circular rotary table. Sufficient rotational energy is supplied to the rotary table through motors or the like, moving the rotary table in a circular fashion. The rotary table provides a central kelly bushing which provides a central opening or bore through which passes the drill string. The kelly bushing provides usually four "pin holes" which are receptive of pins on the master bushing which when interlocked with the kelly bushing, drives the kelly. The rotary table, kelly, master bushing and kelly bushing are art terms which refer to the various parts of the drilling rig which actually impart the needed rotational force to the drill string to effect drilling. Such well drilling equipment is known in the art.

When adding or removing a joint of pipe from the drill string, wedges which are called "slips" are jammed into the rotary table central opening into a bowl to wedge the drill pipe, preventing its fall into the well bore. Often, placement of the slips is manual, and slips or slip assemblies (assemblies of a plurality of slips linked together) usually provide handles for gripping and lifting by well personnel referred to as "roughnecks." Usually, rigs are equipped with such "hand slips". When the pipe is disconnected using a power tong or the like, the remaining portion of the drill string can be supported so that additional sections of pipe can be added to/or removed from the drill string, for example.

It should be point out, that the slips are not normally removed from their position holding the drill string until the drill string is supported from above, thus removing any chance for the drill string to fall unsupported into the well bore.

Sometimes "roughnecks" operating the various mechanical devices in proximity to the rotary table are required to remove an entire drill string from the well bore. This is a time consuming process (called "tripping," or "making a trip") which requires removal of a length of pipe or "joint" at a time in order to completely remove the drill string. This repeated removal from the drill string, and of each joint of pipe, necessarily requires the roughnecks to repeatedly remove the slips or slip assemblies from their operative position holding the drill string, and back into an operative position when the next section of the drill string is in its proper position. At each deletion of a length of drill pipe from the string (as during a "trip"), personnel such as roughnecks are required to exert a great amount of manual physical labor to remove/replace slips, which is not only dangerous in and of itself because of the large forces, but also the great amount of weight which is being handled. The repetetive labor gradually weakens the roughnecks, lowering their ability to do their job as precisely, raising the risk of injury to the individual and to those working with him.

Several patented devices have attempted to address the problem of supporting the pipe at the rotary table while joints are being added or subtracted from the drill string. Also, the art has produced devices directed to the problem of inserting and removing the slips from the rotary table.

U.S. Pat. No. 1,552,062 issued to G. Krell entitled "Clamping Device" relates to pipe clamping apparatus in oil drilling. The apparatus is comprised of a pair of jaw members on rocker arms which are pivoted against and away from the pipe section with the use of a lever which is manually operated.

U.S. Pat. No. 1,481,378 issued to G. F. LeBus entitled "Slip" comprises a pair of L-shaped slips which in the upstanding position, a curved portion rests against the walls of a drill pipe and prevents the pipe from lowering by engaging the pipe below the collar section. The L-shaped slip is then released by rocking backward and lying flat against the rotary table.

U.S. Pat. No. 2,340,597 shows a device in which an actuating mechanism manually operable from the side of a well pipe can move a slip carrier upwardly and downwardly relative to a slip bowl.

U.S. Pat. No. 2,151,208, 2,245,992, and 3,742,562 all show various well pipe supporting spiders, which include generally vertically movable slips which are not capable of rotating with the pipe as is desirable in a rotary table arrangement of typical well drilling installations. In U.S. Pat. No. 2,151,208 there is provided a spider body having slips which are actuable upwardly and downwardly by a pivoting lever with a spring urging the slips downwardly to their active position and a latch being operable to hold the lever in its retracted position.

Other examples of power slip arrangements can be seen in U.S. Pat. Nos. 2,939,683; 3,210,821; 3,270,389; 3,457,605; 3,961,399; 2,570,039; 2,641,816; 4,253,218; and 4,203,182.

U.S. Pat. No. 1,741,055 issued to J. N. Hicks, et al, entitled "Elevator" relates to an improved elevator and utilizes a horizontally swinging gate pivoted to the elevator body, and is further provided with a swinging latch pivotally mounted on the body in position to be deflected by the free end of the gate as it swings in the closed position.

U.S. Pat. No. 1,790,225 issued to S. L. Campbell entitled "Slip Elevator" provides for an elevator wherein the gate has horizontal swinging movement only and vertically movable wedge slips are carried both on the body and the gate portions, all of the slips being movable together when the gate is closed. The slips are operated by a segmental and rotatable cam ring carried within the pipe receiving opening between the body and the gate, the cam ring comprising two parts, one each for the body and gate. Wedge slips are supported on the ring assembly and caused by cam action to move vertically when the ring is rotated. The wedge slips are raised and returned to their positions by rotating the cam ring in the opposite direction.

U.S. Pat. No. 2,607,098 issued J. H. Wilson entitled "Slip" provides a device for the automatic unlatching of slips at a predetermined point during the ascent of the pipe, thereby releasing the grip on the pipe. The structure maintains the slips in the released position until it is desired to reengage the pipe again. At this point, a lever may be tripped manually which would release the slips and allow them to drop by gravity into wedging engagement with the pipe.

U.S. Pat. No. 2,580,828 issued to W. H. Pearce entitled "Pipe Holding Slip" is primarily concerned with providing a novel type of counter balancing means for the slip sections which will relieve the workman from the major portion of the load in lifting the slips from or lowering the slips into the bushing of the rotary. The invention also includes a slip counter balance connected to the slips in a novel manner with means for controlling the counter balance.

U.S. Pat. No. 3,834,751 issued to W. L. Brackin entitled "Transfer Elevator for Integral and Collar Tubing" relates to a transfer elevator for handling pipe wherein an elastic element such as a spring holds the slips in a retracted position until the elevator reaches the desired setting location on the pipe. A force is applied downward on a rope attached to the elevator body thereby causing movement of a lever and the setting of the slips. The weight of the pipe maintains the slips in position until the pipe is set down and the weight is removed. Once the weight of the pipe is removed, the spring will return to the unflexed condition causing the slip inserts to release their grip on the pipe.

U.S. Pat. No. 3,670,374 issued to T. J. Hayes, Jr., entitled "Double Acting Slips" provides for a double acting slip with a first surface adapted to fit against the wall of a pipe and being wedge shaped so that it would wedge in between the pipe and the bowl. The second surface of the slip would have a recess wherein a ball bearing would slip into the recess when that part of the slip was in position adjacent to the bearing. The bearing would be set on a spring which would cause it to move upward into the recess of the slip.

U.S. Pat. No. 3,025,582 issued to J. S. Taylor entitled "Spider and Slip Construction" provides a body member on which are mounted vertically movable slips. The apparatus provides for the lowering of pipe down which would draw the slips into full position along the pipe and engage them against the pipe thus holding it in place. In order to release the slips, it is necessary only to relieve the weight of the tubing on the assembly whereupon the operating handles may be manipulated in the opposite direction to return the parts to the full line position. Generally, the invention stresses that much less force is needed in order to retrieve the slips because of horizontal force rather than vertical force acting on the pipes.

U.S. Pat. No. 1,562,469 issued to J. D. Nixon entitled "Tubing Slip and Spider" relates to a manually operated slip apparatus wherein the handles are moved together and the lower ends of the slip jaws drop into the opening around the pipe. The jaws are anchored together in the hole and they engage the pipe uniformly all the way around it. In order to release the slip, the tubing is pulled upwardly until the lower ends of the jaws clear the top of the spider and the slip is then opened suddenly by hand to seat the jaws on the top of the bowl and in readiness for use again.

A "Well Slip Assembly" is the subject of U.S. Pat. No. 4,253,219 issued to Egore Krasnov.

U.S. Pat. No. 3,961,399 is the subject of a "Power Slip Unit" issued to George Boyadjieff.

U.S. Pat. No. 4,203,182 provides a "Slip Assembly" issued to George Boyadjieff and Jerry Gill.

Many powered slip elevator devices are positioned either on or about the rotary table substantially in the rotary table bowl portion. These devices suffer because the moving part portions are subject to constant contact with drilling mud and quickly become inoperable or require constant maintenance for their proper operation.

These prior art devices fail to consistently and smoothly elevate and replace the slips in the rotary table at the rotary table bowl in such a position as to secure the drill pipe.

Most of these devices provide very complex assemblies which require a complete installation and replacing of existing equipment including in some cases the existing rotary table and bowl. This replacement of equipment is quite expensive and necessarily raises to expensive levels the cost of an entire assembly required. It would be desirable to have a slip elevator which could inter alia be added to existing slips, bowl, rotary table and other such well drilling equipment without modification and without the expenditure of unnecessary amounts of money. It would be desirable that such an elevator apparatus be compatible with existing well drilling equipment, and be connectable thereto deriving in part its support from existing equipment.

The present invention solves these prior art problems in a simple and inexpensive manner. With the present invention there is provided a slip operator apparatus which is adjacent the rotary table but assumes an offset position from the well bore and provides operating parts which are removed from the immediate area of the rotary table, avoiding the problem of heavy maintenance provided by the constant presence of drilling mud at the bore portion of the rotary table.

It is thus an object of the present invention to provide a mechanically simple and easily maintained slip elevator which quickly attaches to the existing well drilling rotary table, to lower or raise existing hand-type slips from their position at the rotary table of the oil/gas well drilling rig.

It is another object of the present invention to provide a slip elevator which operates hand slips absent input rig power such as electricity, pneumatics, etc.

Another object of the present invention is to provide a slip elevator apparatus for use in elevating hand slips which only allows the elevator to raise the slips when the drill pipe is supported from above, but not when the slips are engaged with the drill pipe and holding it from falling free into the well bore.

Another object of the present invention is to provide a slip operator which is offset from the rotary table area allowing free insertion/removal of the drill pipe from the well bore.

Another object of the present invention is to provide a slip operator which removes critical operating parts from the drill pipe and its associated drilling mud.

Still another object of the present invention is to provide a convenient slip elevator having removable connections to the existing hand slips and existing rotary table portions of the drilling rig.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
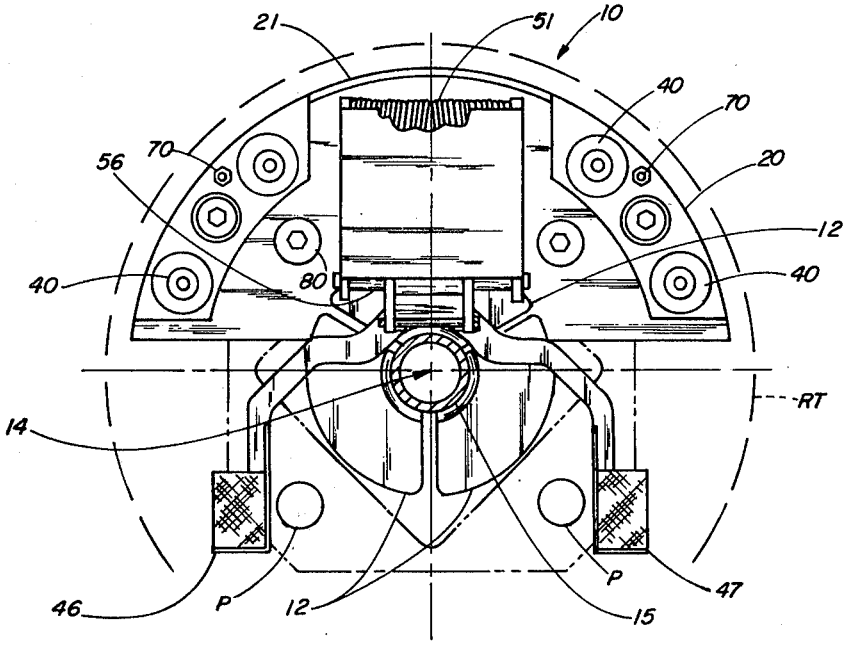
FIG. 1 is a top view of the preferred embodiment of the apparatus of the present invention.
Figure 2:
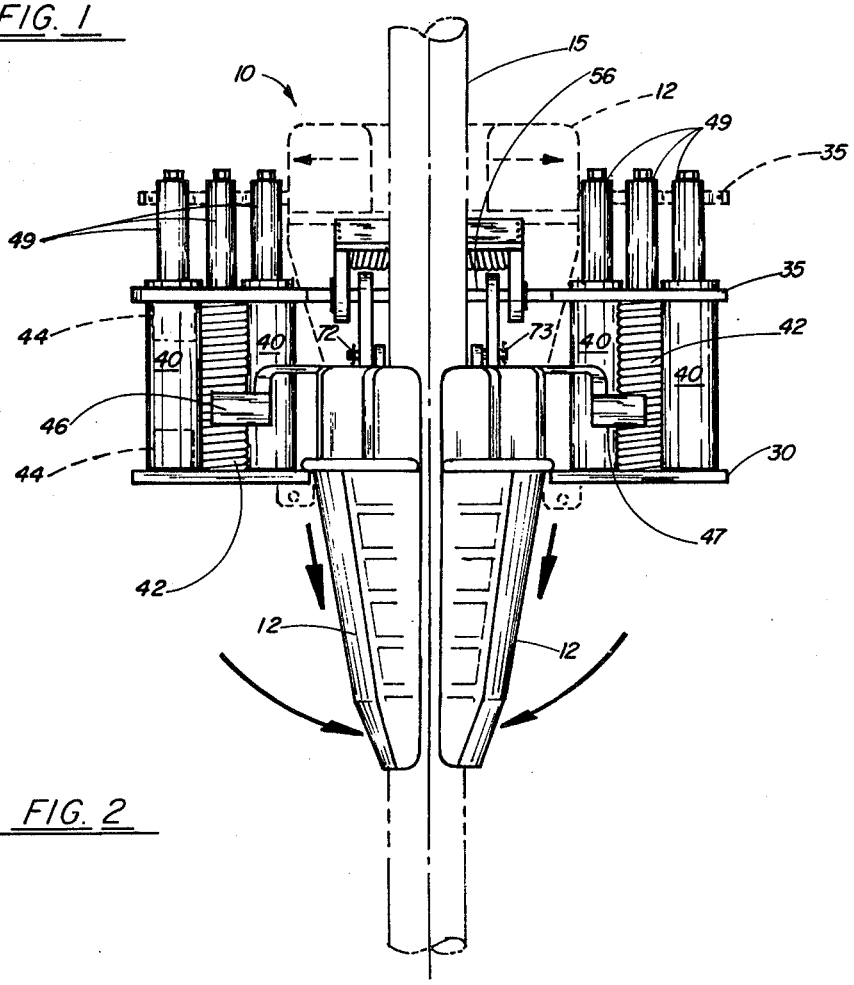
FIG. 2 is a front elevational view of the preferred embodiment of the apparatus of the present invention.

FIGS. 1 through 5 illustrate the preferred embodiment of the apparatus of the present invention designated generally by the numeral 10. In FIGS. 1 and 2, there can be seen a plurality of hand slips 12, each of which can be connected together by link members, for example, so that lifting would be by connection of the apparatus 10 to the center slip. In FIG. 1, three slips 12 are seen which are spaced 120° degrees apart about radial axis 14. Axis 14 would, as best seen in FIG. 1, be the center of drill pipe 15, rotary table RT and also the center of frame 20 outermost curved wall 21.

Frame 20 comprises in part a base plate 30 which normally rests against and interlocks with rotary table RT at the rotary table pin openings P. Spaced vertically thereabove is carriage 35. Carriage 35 is supported above base plate 30 by means of a plurality of bearing assemblies 40. Expansible and compressible coil springs 42 preferably bottom upon base plate 30 and at their upper end lift against and support carriage 35. Carriage 35 would preferably move between uppermost (FIG. 3) and lowermost (FIGS. 2 and 5) positions to alternately and sequentially raise and lower slips 12 from an operative position (FIG. 1) to a retracted laterally removed position (FIG. 3) from drill pipe 15. Coil springs 42 could be laterally supported by disposing each spring 42 about a shaft 49.

Both positions of slips 12 are seen in FIG. 2 with the operative downward position shown in dark lines in FIG. 2 and with the uppermost retracted position seen best in phantom lines. Arrows in FIG. 2 show generally the paths of movement of slips 12.

Figure 3:
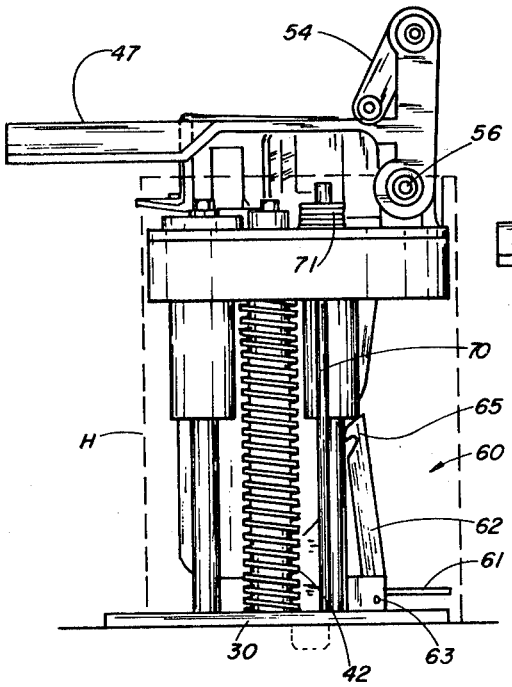
FIG. 3 is a side view of the preferred embodiment of the apparatus of the present invention with the carriage and linkage in the uppermost retracted position.
Figure 4:
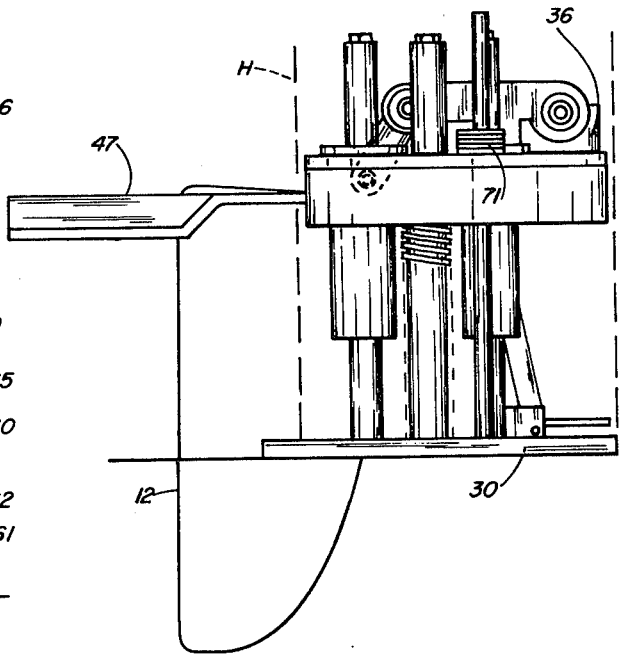
FIG. 4 is a side view of the preferred embodiment of the apparatus of the present invention with the carriage and linkage in an intermediate position.
Figure 5:
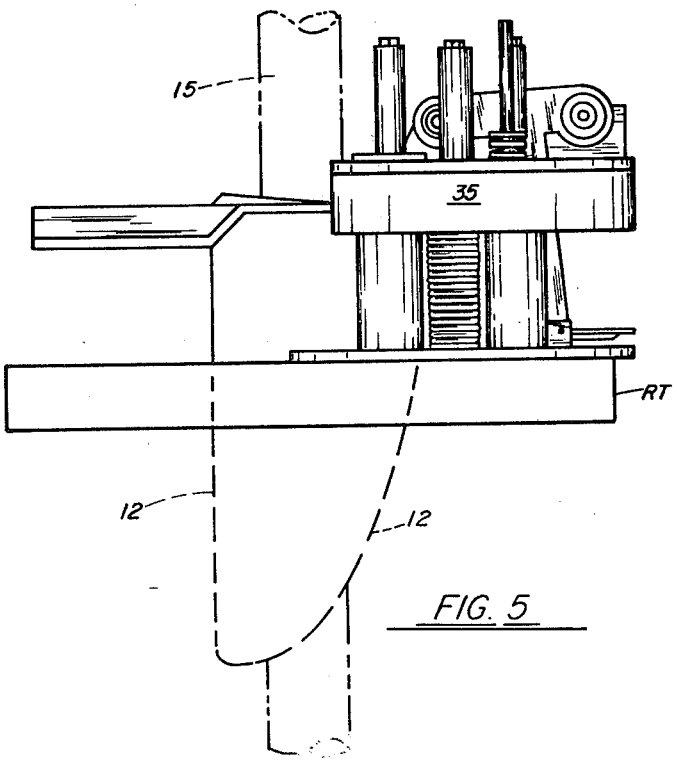
FIG. 5 is a side view of the preferred embodiment of the apparatus of the present invention with the carriage and linkage in a lowermost operational position.

A pair of footpegs 46, 47 are seen best in FIGS. 1 and 2. Footpegs 46 are connected, for example, to carriage 35 or to slips 12 for loading carriage 35 with live load, such as the weight of a human being, for example, when he steps on footpegs 46, 47 with his foot during operation standing thereupon. Such a loading would overcome the biasing effect of coil springs 42 as desirable, moving the slips 12 from their uppermost position as shown in FIG. 3 to the lowered operative position of FIG. 2 which would place slips 12 into engagement with drill pipe 15 holding and supporting it as is desirable.

In order to lift carriage 35 upwardly, coil springs 42 are provided. Additional means for removing slips 12 upwardly and laterally away from drill pipe 15 is seen with slip spring assembly 50 (see FIG. 7). Slip spring assembly 50 provides spaced plates 52 and attached link arm 54 which move in an arcuate path to move slips 12 upwardly and laterally away from drill pipe 15 to a fully retracted and laterally removed position as shown in FIG. 3.

Latch mechanism 60 including pedal 61 and attached latch arm 62 are provided for catching/releasing carriage 35. Carriage springs 42 allow carriage 35 to move upwardly to the position of FIG. 3 when footpeg 61 is depressed moving arm 62 pivotally about pivot pin 63. Hook 65 grasps locking pin 53 to retain carriage 35 in the lowest position.

Figure 11:
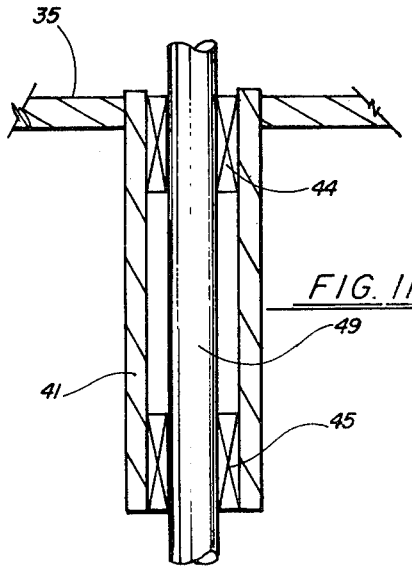
FIG. 11 is a sectional fragmentary view of the carriage bearing assembly portion of the preferred embodiment of the apparatus of the present invention.

Bearing assemblies 40 (FIG. 11) comprise sleeve 41, each housing a pair of upper and lower bearings 44, 45 which ride upon shafts 49. Bearings 44, 45 are aligning-type ball bearings such as are commercially available under the trademark "Thomsom Super."

FIGS. 3–5 and 7 show more particularly the construction of slip spring assembly 50. Slip spring assembly 50 is comprised generally of a pair of spaced apart supports 51, 52, each connected at their ends in a pivotal fashion by a pair of shafts 56, 57. Each shaft would be provided at its end portion with bearings B as needed.

Mounted upon the two shafts 56, 57 would respectively be link member 54 and slip spring 51. Link member 54 provides openings 55 that would affix to slip shafts 72, 73 as best seen in FIG. 2, thus forming a connection between slip spring assembly 50 and slips 12. Slip spring 51 would bias supports 52 and link 54 upwardly normally to the position shown in FIGS. 3 and 7. This would move the attached slips 12 laterally away from the center 14 of the well bore allowing the easy and unobstructed entry and removal of drill pipe 15 as is desired.

Figure 6:
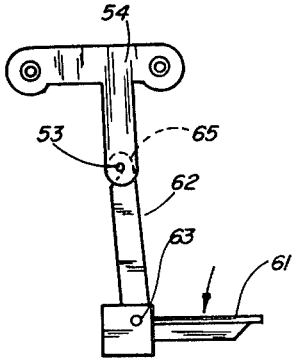
FIG. 6 is a fragmentary view of the linkage portion of the preferred embodiment of the apparatus of the present invention.
Figure 7:
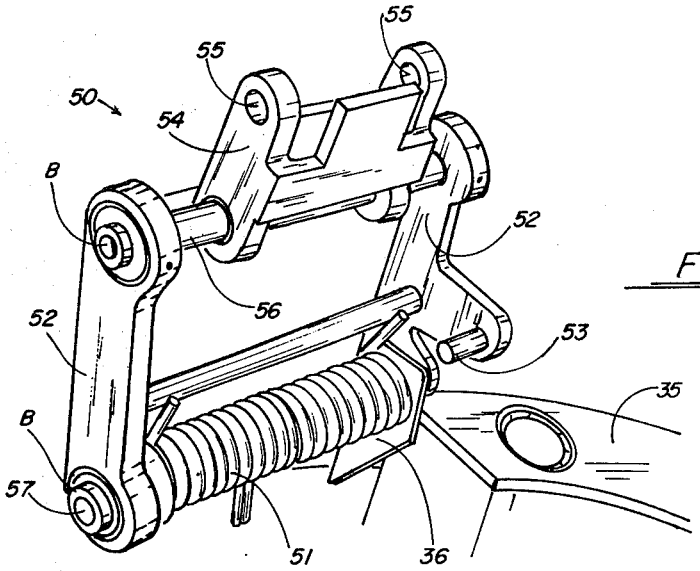
FIG. 7 is a fragmentary perspective view of the spring slip portion of the preferred embodiment of the apparatus of the present invention.
Figure 8:
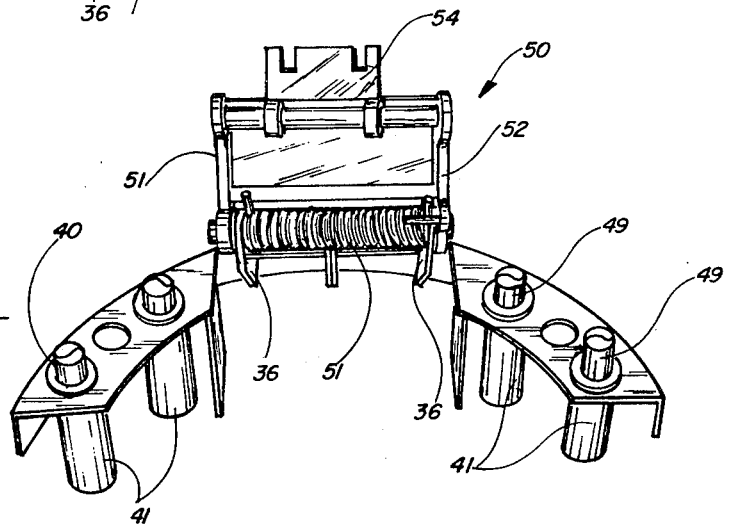
FIG. 8 is a perspective view of the carriage and attached carriage spring portions of the preferred embodiment of the apparatus of the present invention.

A locking pin 53 would extend inwardly as best seen in FIG. 7 and would be attached by hook 65 of lever arm 62 as aforementioned with respect to discussions of FIG. 6. Shaft 56 would also allow attachment of shaft 57 to mounting brackets 36 which would be welded, for example, to carriage 35. Thus, the entire spring slip assembly would move with and be supported by carriage 35.

The combination of coil springs 42 and spring slip assembly 50 provides an upward and laterally removed movement of the hand slips 12 when they are removed from the well bore adjacent drill pipe 15. This provides not only vertical movement of the slips 12 but also lateral movement away from axis 14 as is desirable.

Figure 9:
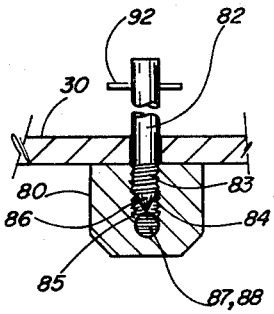
FIG. 9 is a fragmentary sectional view of the anchor assembly portion of the preferred embodiment of the apparatus of the present invention.
Figure 10:
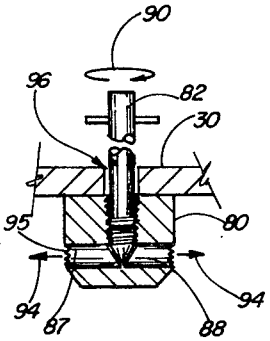
FIG. 10 is a fragmentary sectional view of the slip anchor assembly portion of the preferred embodiment of the apparatus of the present invention.

FIGS. 9 and 10 illustrate anchor assemblies 80, each of which would be welded, for example, to base plate 30. Each anchor assembly 30 provides a shaft 82 which provides at its lower end portion male threads 83 that cooperate with provided female threads 84 of bore 85. The lowermost tip 86 of shaft 82 would be conically tapered and would cooperate with locking pins 87, 88.

Each locking pin 87, 88 provides a beveled surface adjacent and abutting tip 86 so that upward and downward movement of shaft 82 responsive to rotation (see arrow 90, FIG. 10) produces a corresponding lateral movement of each pin 87, 88. Assembly 80 would normally occupy pin holes P in the rotary table RT of the drilling rig which would be on existing equipment. Thus, no modification to the existing rotary table need be performed as the locking assembly 80 would be similarly sized to and corresponding with the locking pins (not shown) of the master bushing used on the particular rig with the particular rotary table in question. Thus, the entire apparatus 10 could be attached directly to the rig rotary table at the pin holes P of the rotary table. Rotational energy applied to shaft 82 at handle 92 would provide the necessary torque in order to move pins 87, 88 outwardly as shown by the arrows 94 in FIG. 10. The outermost faces of pins 87, 88 could be provided with serrations 95. An opening 96 would be provided in base plate 30 allowing free rotation of shaft 82 with respect to base plate 30 so that it can move as desired within the threads 84 of bore 85.

Frame 20 is substantially semi-circular in shape as viewed from above (FIG. 1). Frame 20 is laterally removed from drill pipe 15 allowing free insertion and removal of drill pipe 15 from the well bore and from the center 14 of rotary table RT. A protective housing H provides a dust cover (phantom lines, FIGS. 3 and 4) about frame 20 to discourage the entry of dust, drilling mud or other abrasive material to the working mechanism. Guide pins 70 as desired could insure proper alignment of carriage 35 with base plate 30, as well as function as stops to limit the upward movement of carriage 35 with respect to base plate 30. Guide pins 70 would threadably attach to base 30 and would provide an enlarged retainer nut 71 to stop upward movement of carriage 35. Slips 12 would attach to link arm 54 by means of slip shafts 72, 73 which would normally be a part of each slip 12, welded thereto, for example.

Apparatus 10 could be manufactured of metal such as steel, and be of generally welded construction.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A slip elevator apparatus for use on drilling rigs having an existing rotary table with pin openings, spaced radially from the table control axis, comprising:

a. a frame;

b. anchoring means associated with the frame for removably affixing the frame to a drilling rig rotary table at the rotary table pin openings, while allowing the frame to rotate therewith, the frame occupying during operation a peripheral position on the rotary table, leaving an open center which allows drill pipe to freely penetrate the rotary table center;

c. linkage means forming a connection between the frame and a set of slips to be lifted, the linkage means being movably disposed with respect to the frame between upper and lower position; and d. biasing means for urging the linkage into the upper position.

2. The apparatus of claim 1 wherein said frame provides a curved base occupying a position radially spaced during operation from the rig rotary table center, allowing drill pipe to freely penetrate the rotary table center.

3. The apparatus of claim 1 wherein said biasing means comprises at least one compressible coiled spring.

4. The apparatus of claim 1 wherein said frame comprises:

i. a base plate structure;

ii. a carrier spaced above said base plate and carrying said linkage means;

iii. a coil spring assembly connecting said carrier and said base plate allowing relative movement therebetween responsive to expansion/contraction of said coil spring assembly.

5. The apparatus of claim 1 wherein said linkage comprises a linkage element movable connected at one end portion thereof to said frame and at the other end portion thereof providing means for attaching said linkage member to a set of hand slips to be elevated.

6. The apparatus of claim 4 further comprising footpeg means for applying a live load to said linkage carrier.

7. The apparatus of claim 1 wherein said frame is generally semi-circular in configuration and provides an outermost curved wall having a center which is defined generally by the rotary table center during operation.

8. The apparatus of claim 1 wherein said linkage means comprises:

i. a linkage carrier supported generally above said frame, said carrier moving during operation in a vertical path relative to the lowermost portion of said frame between upper and lower positions;

ii. a jointed arm affixed at one end portion to said carrier and at its other end portion providing means for attaching said jointed arm to a set of slips to be elevated.

9. The apparatus of claim 1 wherein said frame comprises a base plate structure, and a linkage carrier movably disposed with respect to said base plate, and said biasing means comprises at least one compressible, extendable coil spring mounted at one end portion on said base plate and extending upwardly, supporting at its uppermost portion said carrier, and second spring means carried by said carrier.

* * * * *